United States Patent [19]

Lach

[11] Patent Number: 4,963,710

[45] Date of Patent: Oct. 16, 1990

[54] PROCESS AND DEVICE FOR MECHANICAL GRINDING OR SHARPENING OF WORKPIECES BY USE OF ELECTRICALLY CONDUCTIVE GRINDING OR SHARPENING TOOLS

[76] Inventor: Horst Lach, Dammstr. 5, D-6450 Hanau, Fed. Rep. of Germany

[21] Appl. No.: 198,808

[22] Filed: May 25, 1988

[30] Foreign Application Priority Data

May 25, 1987 [DE] Fed. Rep. of Germany ..... 3717568

[51] Int. Cl.[5] ..... B23H 5/04

[52] U.S. Cl. ..... 219/69.2; 219/69.16

[58] Field of Search ..... 219/69 V, 69 M, 69.2, 219/69.17, 69.16; 51/165.74, 165.75, 165.76, 165.71, 165.87

[56] References Cited

U.S. PATENT DOCUMENTS

| | | | |
|---|---|---|---|
| 3,862,517 | 1/1975 | Porter, Jr. | 51/165.75 |
| 4,236,985 | 12/1980 | Grodzinsky et al. | 219/69.17 |
| 4,827,213 | 5/1989 | Spaude | 219/69.16 |

FOREIGN PATENT DOCUMENTS

| | | | |
|---|---|---|---|
| 2422940 | 12/1975 | Fed. Rep. of Germany . | |
| 103297 | 9/1978 | Japan | 219/69.16 |
| 259332 | 12/1985 | Japan | 219/7.5 |
| 8301216 | 4/1983 | PCT Int'l Appl. . | |
| 639889 | 12/1983 | Switzerland . | |
| 838297 | 6/1981 | U.S.S.R. | 51/165.74 |

*Primary Examiner*—A. D. Pellinen
*Assistant Examiner*—Geoffrey S. Evans
*Attorney, Agent, or Firm*—Larson and Taylor

[57] ABSTRACT

A process for the mechanical sharpening of workpieces using electrically conductive sharpening tools provides that, procedurally, first an electric spark gap is created between a sharpening tool (18) and workpiece during the contact of the sharpening tool (18) on the workpiece (10), and the contact position is determined by the arc discharge. Subsequently, for the sharpening process, the spark gap or potential is disconnected or is adjusted to such a value that essentially only a mechanical material removal occurs. The process is especially advantageous as executed on a device which provides electro-erosion processing or sharpening by the effects of electro-erosion, because then the control circuit (32) which is present for these purposes can be used not only for control of the spark gap during the electro-erosion treatment, but also for the contact of the sharpening tool.

7 Claims, 1 Drawing Sheet

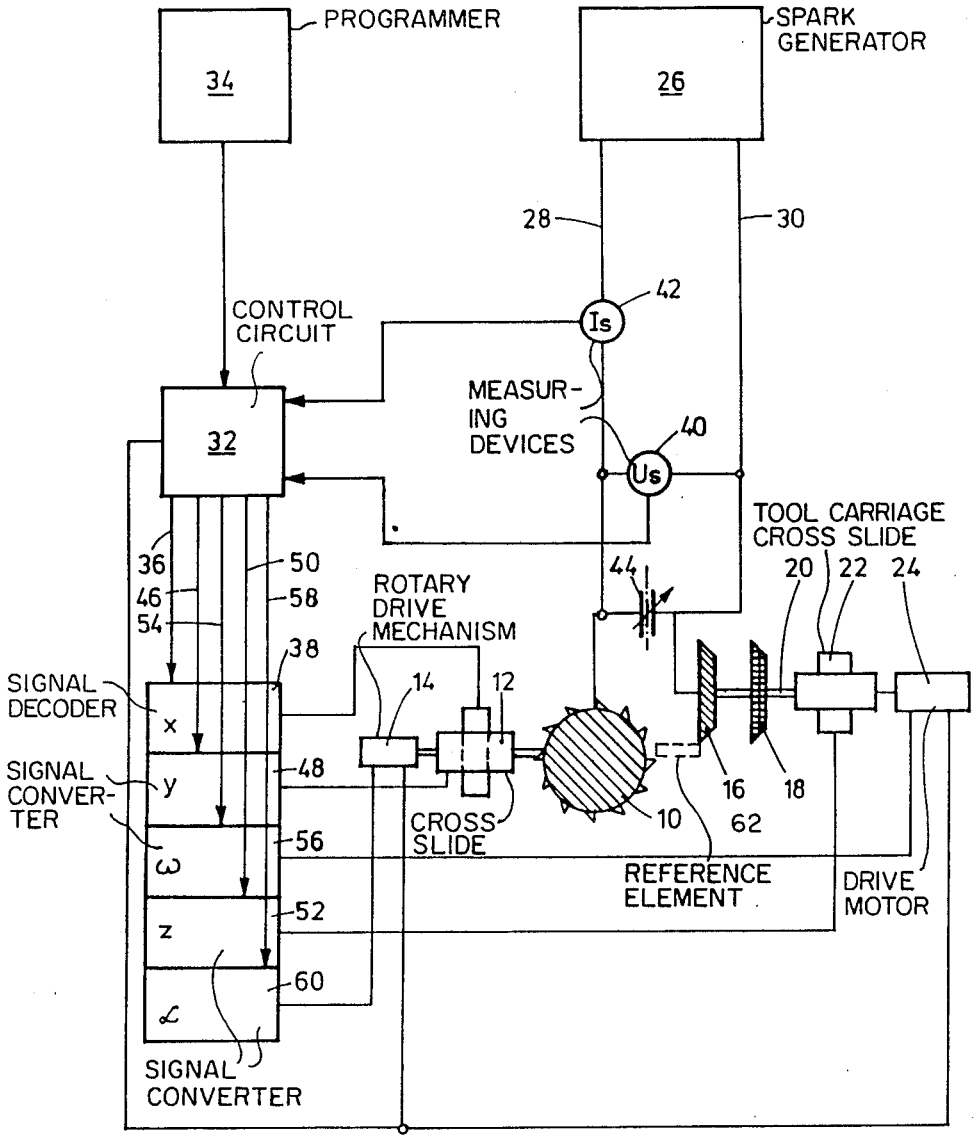
PROGRAMMER
34
SPARK GENERATOR
26
28
30
42
Is
CONTROL CIRCUIT
32
MEASURING DEVICES
40
Us
TOOL CARRIAGE CROSS SLIDE
20
22
24
44
36
46
54
50
58
38
ROTARY DRIVE MECHANISM
14
12
SIGNAL DECODER
x
SIGNAL CONVERTER
y
48
16
18
10
62
CROSS SLIDE
56
REFERENCE ELEMENT
DRIVE MOTOR
z
52
60
SIGNAL CONVERTER

PROCESS AND DEVICE FOR MECHANICAL GRINDING OR SHARPENING OF WORKPIECES BY USE OF ELECTRICALLY CONDUCTIVE GRINDING OR SHARPENING TOOLS

The invention relates to a process for the mechanical shaping, e.g., grinding or sharpening of workpieces by means of electrically conductive shapening tools, in which first of all a contact of the sharpening tools to the workpieces or a sensor occurs and then certain delivery and feed-in movements are excuted, as a result of this contact position, as well as a device for execution of such a process.

In the case of the mechanical sharpering processes with which the present invention is concerned, unitl this time, when the position of the surface to be shapened within the space considered and/or the diameter of the shapening disk are not precisely predetermined, the sharpening tool is driven up all the way to its contact on the workpiece, in other words the workpiece is actually contacted, and then the feed and delivery movements are executed according to a certain control program. At this time, the contact always occurs by means of manual control, in which the operator aligns the tool according to the noise arising during contact and according to the amplitude of the formation of sparks, in order to carry out and complete the sharpening process. If for instance a plurality of different and different use tool cutting edges are to be resharpened in a certain setting of a workpiece or a group of workpieces, for instance in the case of the teeth of a sawblade, the cutting edges of a milling tool or a number of turning tools introduced in common into a chuck or work-locating fixture must be manually recontacted before the beginning of the resharpening of any new cutting edge. It is not possible to automatically process all of the cutting edges one after the other. The same is true for shapening processes occuring during the manufacturing process, wherein when the prefabricated workpieces have different original dimensions, differences arise during the workpiece clamping or setting or else the sharpening disk diameter may not be constantly checked and readjusted.

Spark erosive or treatment processes, even the so-called spark grinding or respectively erosion grinding for instance according to European Patent A1-076 997, in which the removal of the material occurs essentially without contact, as a result of the sparks flashing over between tool and workpiece, are carried out at least at the beginning by use of a certain spark gap, of which the maintenance is controlled dependent upon the arc discharge length. Even in the case wherein with workpieces which include electrically noncunductive materials, for instance diamond cutters, in a metal matrix which is electrically conductive, even while a mechanical removal of the electrically nonconductive material components is taking place, even so this does not occur until following a certain degree of spark—erosive removal of the metal matrix, in which case the electrically nonconductive components parts are for the most part exposed, so that they can be easily struck off by the tool which is operating in terms of spark erosion. The control circuit which is controlled dependent upon arc discharge therefore until this time has had mainly the function from the beginning of the process of providing for the spark-erosive removal to the distance required (=the spark gap) of the electrically conductive material from the workpiece without any contact. A deliberately executed initial contact followed by essentially mechanical material removal does not happen within the context of the presently known spark-erosion processes.

The object of the invention is to considerably improve the aforementioned mechanical sharpening process so that it can be executed automatically and more rapidly, and the primary problem is solved according to the invention in that an electric spark potential is established during the contact between shapening tool and workpiece or sensor and the contact position is determined by the arc discharge, and in that subsequently the spark potential is disconnected or switched off for the shapening process or else is set at such a value that an essentially mechanical meterial removal occurs.

The greatest importance inheres in the process according to the invention wherein a contact controlled by arc discharge occurs before the material removal process according to the invention, in which the known and traditional control circuit with spark generator, which has been used until this time but only with a different removal procedure for a different purpose, in other words coordination of the distance during the spark-erosive treatment, can be used advantageously. No work power current needs to be transmitted of course for the removal task, since the arc discharge serves exclusively for the control of a certain contact position, while the removal of the material occurs essentially mechanically.

The electrically nonconductive grain of the sharpening disk during the contact also provideds for the mechanical removal of electrically conductive material from a workpiece for a certain distance between this workpiece and the metallic matrix of the sharpening disk, so that in the invention the possibility also exists of allowing the existence of another spark potential between tool and workpiece, in conformance with the electrically controlled contact, and if it is a weak spark potential, which is of no importance for the metal removal process, allows continuous control of a certain contact position or setting of the sharpening disk for mechanical removal of the electrically conductive material of the workpiece.

If the cutting edges of a milling tool, for instance, are to be sharpened with the respective surfaces arranged at certain settings relative to one another, then in one preferred practical embodiment of the invention either before and/or following the sharpening of one of the surfaces, the surface can be contacted by means of an arc discharge, and in accordance with the contact position, the other surface could be sharpened or the adjustment movements of the other surfaces could be undertaken for compensation of the wear of the sharpening disk. Instead of using a certain surface on a workpiece as reference for the automatic sharpening of other surfaces, a model or reference surface or a sensor, i.e., reference element, could also be contacted with the sharpening tool and could be used as reference for all of the surfaces to be ground or sharpened.

One especially great advantage is ofered by the new process when according to another preferred embodiment of the invention the workpiece is first of all treated by spark erosion or erosing grinding with a first tool and then is brought in the same setting or condition by means of arc discharge into the contact position for the next process step of mechanical material removal by means of a sharpening disk. In this variation of embodiment there is not only the rapid and automatic contact, but also the precision is additionally enhanced, and with the two treatment steps executed one after the other, the workpiece remains in the same setting and position and the relative positions of both of the tools are controlled in the same manner.

One device for execution of the process according to the invention consists of a rotary operable, electrically conductive sharpening tool, a workpiece clamping device and a controllable motive or travel power mechanism for variation of the relative position between sharpening tool and workpiece and is characterized in that the sharpening tool and the workpiece or a sensor can be connected to a spark generator and the motive or travel power mechanism can be controlled during the contact by a control circuit which is influenced or controlled by the arc discharge, which during the mechanical sharpening process can be controlled byt a control program and/or an arc discharge considered only as control current.

The new device can be realized quite simply and at low cost, in that the sharpening tool can be mounted on the spark generator and the control circuit of a spark-erosively effective tool, which can be introduced into th same workpiece setting, and the tool in one preferred embodiment is arranged as an eroding disk mounted on the same shaft as the mechanically operating sharpening tool.

The invention is explained in more detail hereinafter relative to the drawing which is block diagram of a device for grinding or sharpening workpieces, in accordance with a preferred embodiment of the invention.

The drawing is a diagrammatic representation of a workpiece 10, for instance a sawblade, which is positioned on a cross slide 12 and thus can be driven in the directions of two coordinates x and y which are perpendicular to each other. A rotary drive mechanism 14, of which the angle of rotation, alpha, can be controlled, serves for the setting of the angle of rotation or respectively and furthermore for the step-by-step action of shifting the sawblade from the one cutting edge which is being treated to the next sawblade cutting edge.

Two tools 16 and 18 are provided for the treatment of workpiece 10. Tool 16 is a rotary drivable disk, which may be of graphite, copper or some other electrically conductive material, and if desired it is also provided with sharpening granules of electrically nonconductive material included in the material of the tool, which may be diamond crystal. With this tool the sawblade 10 or some other workpiece, for instance even on its cutting edges, which for instance may consist of hard metal or polycrylstalline diamond, is fed to a milling tool or to some other similar tool to be worked by means for spark erosiohn or by erosion grinding or sharpening.

The second tool 18 is an electrically conductive tool. In other words, it may for instance be a metal-coated sharpening disk with for instance diamond grains. Both tools 16 and 18 are mounted on the same drive shaft 20 and can be driven by a tool carriage cross slide 22 in the direction of a z-coordinate which is perpendicular to the x-and y-coordinates. Also, the angle velocity omega of the shaft 20 powered by a drive motor 24 may be controlled and adjusted.

A spark generator 26 is connected through lines 28 and 30 to workpiece 10 and also connected to whichever tool is being used, 16 or 18 respectively. A dielectric i.e., a non-conducting, liquid is traditionally fed by jet action between workpiece 10 and the relevant tool 16 or respectively 18, so that the tool and workpiece are insulated from one another and sparks can jump across between them, if or when the erosion grinding tool 16 is located in a work position in the intermediate distance required by the spark gag for the spark erosion or respectively if or when contact is made between sharpening tool 18 and workpiece 10. An noted peviously, a reference element or member, indicated schematically at 62, can also be used as a reference instead of workpiece 10.

The regulations settings, feed movements and theoretial value adjustments can be undertaken in the individual cases by use of a control circuit 32. The data required for use in the control circuit could be fed into said control circuit either manually through a not shown keyboard or by means of a present program 34. This can then be subjected to movement by means of a line 36 and a signal decoder 38 to the cross slide 12, movement in the direction of the x-coordinate, whereupon for instance the spark gap between workpiece 10 and tool 16 can be affected. For the control and readjustment of any particular spark gap, the variations of the electric voltage Us at the spark gap could be measured and adjusted by means of a measuring device 40 and either alternately or simultaneously a variation of the gap current or arc discharge modification Is could be executed by means of a measuring device 42 and could be fed to control circuit 32 for evaluation. Parallel to the length of the spark gap between workpiece and tool there is present a dielectric capacitance 44 which may be incremented by steps, as is already known from metal processing, in order to undertake adaptations.

The adjustment of the tool can be controlled dependent upon the current Is, measured at 42. The value proportional to a current for the size of the spark gap can be fed to a computing and recording comparator, in which said value is compared with an adjustable theoretical value.

The movement of cross slide 12 is steered in the direction of the y-coordinates through a control line 46 and an ac-vf signal converter 48. This for instance can be a back and forth reciprocating movement of the workpiece during the processing of straight cutting edges. The range of the back and forth reciprocal movement can be predetermined by program 34 or by even a simple reversal accomplished by a limit switch arrangement.

Tool carriage 22 is moved by means of line 50 and ac-vf signal converter 52, in the direction of the z-coordinate, in order for instance to undertaken a height adjustment of tool 16 or respectively tool 18.

The speed of drive motor 24 is controlled by control circuit 32 thorugh a control line 54 and an ac-vf signal converter 56. Ultimately dependent upon the individual case, in order with a rotary switching movement to bring workpiece 10 following each step of the treatment and for the treatment of another tooth into another and different rotary angle setting, a suitable signal is conducted from control circuit 32 out through a control line 58 and an ac-vf signal converter 60 to the rotary drive 14 of workpiece 10. According to another and different provision of the treatment, rotary drive 14 can also be a continuously operating motor, if a workpiece is to be processed as rotary body, while it rotates around its own axis during the processing.

The device shown in the drawing is basically suitable for the treatment of all metal workpieces, and actually above all for the production of and for the regrinding or finish-shapening of tools, especially tools with very hard cutting edges, for instance of polycrystalline material. The cutting edges of workpieces could thus be treated first of all with tool 16 by means of a spark erosion process or erosion grinding. The still quite coarse surfaces which are obtained with this process of treatment could then be finally treated by means of sharpening tool 18 in the same setting as that of workpiece 10 and with use of the same control circuit. Thus the possibility is now present either to treat workpiece 10 tooth by tooth or respectively cutting edge by cutting edge if desired, one directly after the other, first with the erosion grinding tool 16 and then with the sharpening tool 18, or primarily to treat all of the teeth or respectively all of the cuttinhg edges with erosion tool 16 and subsequently then all of the teeth or respectively all of the cutting edges one after the other with sharpening tool 18. In the second treatment stage, with use of sharpening tool 18, the arc discharge Is, otherwise known from the aforementioned erosion grinding processing, is so longer used for material removal, but rather is only still used for control of the relative setting between workpiece 10 and sharpening tool 18. Therefore workpiece 10 can be brought quite rapidly and automatically very precisely up to a certain specific distance from or up to contact with the sharpening crystals on sharpening tool 18 —or vice verse tool 18 on workpiece 10—in order to bring tool and workpiece into contact. The desired initial position for the sharpening process, whether it is contacting or is still at a certain intermediate distance between workpiece and tool, can be set very precisely in the described manner, because any spark gap distance between tool and workpiece is also associated in the case of the electrically conductive sharpening tool 18 with a certain arc discharge Is, of which the value is conducted and fed into control circuit 32 and there is compared with a certain theoretical value for the initial position or respectively the contact position. Even during the mechanical sharpening process by means of sharpening disk 18, the spark potential Us can be maintained and preserved, in order to produce an arc discharge current Is in the dimension or range of a measurement current or respectively a control current and in this manner to control the mechanical sharpening contact between sharpening disk 18 and workpiece 10. The eroding or grinding effect of the sparks is maintained at a mimnimum in this processing stage, in order to not negatively prejudice the polishing effect of the mechanical sharpening process.

Finally, the process according to the invention can also be used in connection with maintenance of the sharpening disk feed to the contact point, dependent upon the torque or the speed or rpm's which are induced as a result of the torque. Such a maintenance provides that whenever the counter (contact) pressure of the sharpening disk against the workpiece becomes too great, the sharpening disk is pulled back from the workpiece. Then a renewed approach of tool to material occurs relative to the workpiece. The invention in this case allows the possibility that with withdrawal of the sharpening disk from the workpiece the electric voltage between these two parts is switched on and the arc discharge spark current may then be meaured. This then becomes smaller the greater the distance of the sharpening disk from the workpiece, and at a certain limit value of the spark current, the withdrawal movement of the sharpening disk is maintained and reserved again to the feed mode. Then the spark potential can also be switched off again, until the next time the sharpening disk again presses too strongly against the workpiece, its speed drops below a certain limit value and it must be withdrawn once again from the workpiece.

The process just described shows that the contact of the sharpening disk on the workpiece according to the invention can occur by means of arc discharge not only during an approach movement but also during a withdrawal movement.

I claim:

1. In a process for the mechanical grinding of workpieces by means of electrically conductive grinding tools, wherein there first occurs contact between the grinding tool and one of (a) the workpiece or (b) a reference element and then subsequently at this contact position, certain operational movements are determined and executed, and wherein a non-conductive liquid is fed between the grinding tool and the workpiece to insulate the grinding tool from the workpiece, the improvement wherein during said contact, an electric spark voltage is created between the grinding tool and the workpiece or reference element in contact therewith and the distance to the contact position is determined based on a measured value of the corresponding arc discharge current produced, and thereafter the spark voltage is switched off, or is set at a selected value for the grinding process, and removal of material is effected essentially mechanically, said measured value of said arc discharge current being used as a measurement of said distance in connection with effecting the mechanical removal of material and only in that connection.

2. Process as in claim 1 for grinding of surfaces of the workpiece arranged relative to one another with certain relative settings or adjustements, wherein, in addition to the sharpening of one of the surfaces, the other surfaces are contacted by means of arc discharge and corresponding to this contact position the other surfaces are processed in accordance with the one surface.

3. Process as in claim 1, wherein the workpiece is processed first by spark erosion or by erosion grinding using a first tool and then, in the same setting, the workpiece is processed mechanically to provide removal of material using a sharpening disk brought into said contact position as determined by said arc discharge.

4. A device for providing mechanical grinding of work pieces by means of electrically conductive grinding tools, wherein there first occurs contact between the grinding tool and one of (a) the workpiece or (b) a reference element and subsequently, at this contact position, certain operational movements are determined and executed, wherein a non-conductive liquid is fed between the grinding tool and the workpiece to insulate the grinding tool from workpiece, and wherein during the contact, an electric spark voltage is created between the grinding tool and the workpiece or sensor in contact therewith and the distance to the contact position is determined based a measured value of the corresponding spark current produced, and thereafter, the spark voltage is switched off, or set at a selected value for the grinding process, and removal of material is effected essentially mechanically, the measured value of said spark current produced by said contact being used as a measurement of said distance in connection with effecting the mechanical removal of material and only in that connection, said device comprising a rotary-driven electrically conductive grinding tool, a workpiece support device, a controllable movement drive means for vaying the relative settings between the grinding tool and workpiece, means for selectively connecting the grinding tool and the workpiece or reference element in contact with the grinding tool to a spark generator for generating said spark voltage, and a control circuit for controlling the movement drive means based on the measured value of said spark current produced during said contact.

5. Device as in claim 4, further comprising means for selectively connecting the spark generator and the control circuit to a tool for providing machining by electro-erosion which can be introduced into the same workpiece setting.

6. Device as in claim 5, wherein the grinding tool and the tool for providing machining by electro-erosion are arranged on the same drive shaft and comprise rotary tools.

7. Device as in claim 4, further comprising programmer means connected to said control circuit for controlling the operation thereof in accordance with a program stored in said programmer means.

* * * * *